US010039346B2

(12) United States Patent
Tsai

(10) Patent No.: US 10,039,346 B2
(45) Date of Patent: Aug. 7, 2018

(54) THREE-WAY SHOELACE STRUCTURE

(71) Applicant: Ming-Che Tsai, Changhua (TW)

(72) Inventor: Ming-Che Tsai, Changhua (TW)

(73) Assignee: Ming-Che Tsai, Changhua (TW)

( * ) Notice: Subject to any disclaimer, the term of this patent is extended or adjusted under 35 U.S.C. 154(b) by 101 days.

(21) Appl. No.: 15/223,024

(22) Filed: Jul. 29, 2016

(65) Prior Publication Data

US 2018/0027926 A1 Feb. 1, 2018

(51) Int. Cl.
*A43C 9/00* (2006.01)
*A43C 1/00* (2006.01)

(52) U.S. Cl.
CPC . *A43C 9/00* (2013.01); *A43C 1/00* (2013.01)

(58) Field of Classification Search
CPC ..... A43C 9/00; A43C 1/00
See application file for complete search history.

(56) References Cited

U.S. PATENT DOCUMENTS 6,029,323 A * 2/2000 Dickie ..... A43C 1/003 24/712.1
8,533,978 B2 * 9/2013 Volin ..... A43B 3/0078 24/712.2
2015/0040430 A1 * 2/2015 Conrad ..... A43C 1/00 36/83

* cited by examiner

*Primary Examiner* — Robert Sandy
*Assistant Examiner* — Louis A Mercado

(57) ABSTRACT

A three-way shoelace structure has a first lace, a second lace, and a third lace. When a first three-way shoelace structure and a second three-way shoelace structure are passing through a plurality of eyelets of a shoe, the first lace, the second lace, and the third lace of the first three-way shoelace structure may be tied with the first lace, the second lace, and the third lace of the second three-way shoelace structure to form three tied points so as to bind up and fix at three fixed points of a foot of a wearer.

3 Claims, 5 Drawing Sheets

THREE-WAY SHOELACE STRUCTURE

FIELD OF THE INVENTION

The present invention relates to a shoelace for tying an opening formed at a top side of a shoe, and more particularly to a three-way shoelace structure.

BACKGROUND OF THE INVENTION

The conventional shoelace is used for passing through corresponding eyelets of a shoe. The conventional shoelace is a long string so as to pass through the eyelets and bind up the shoe from two sides toward the center thereof. Therefore, the shoe may tightly cover the foot of a wearer but not be released. Finally, the shoelace is tied to finish wearing.

The tied point of the conventional shoelace is generally formed at the eyelet which is disposed at the uppermost one so as to bind up the foot of the wearer. However, the single on tied point is a fixed position and hard to adjust so that the wearer may not select and the adaptive range is narrow.

In view of the foregoing circumstances, the inventor has invested a lot of time to study the relevant knowledge, compare the pros and cons, research and develop related products. After quite many experiments and tests, the "three-way shoelace structure" of this invention is eventually launched to improve the foregoing shortcomings, to meet the public use.

SUMMARY OF THE INVENTION

An objective of this invention is providing a three-way shoelace structure. When the three-way shoelace structure is tied, there are three tied points are formed from top to bottom so as to bind up three fixed points corresponding to the foot of the wearer. Therefore, the wearer may select one, two, or three of the tied points to tie so as to adapt the feet with different sizes. And furthermore, the market may be more and the uses of the shoes may be much wider.

To achieve above objectives, a three-way shoelace structure is disclosed. The three-way shoelace structure comprises a first lace, one end thereof has a first head; a second lace, one end thereof has a second head, the other end of the second lace opposite to the second head is connected to the other end of the first lace opposite to the first head; and a third lace, one end thereof has a third head, the other end of the third lace opposite to the third head is connected to the other end of the first lace opposite to the first head and the end of the second lace opposite to the second head.

In some embodiments, the first lace, the second lace, and the third lace are formed a Y-shaped structure.

In some embodiments, a diameter of the first lace is larger than a diameter of the second lace, and the diameter of the first lace is larger than a diameter of the third lace.

When a first three-way shoelace structure and a second three-way shoelace structure are passing through a plurality of eyelets of a shoe, the first lace, the second lace, and the third lace of the first three-way shoelace structure may be tied with the first lace, the second lace, and the third lace of the second three-way shoelace structure to form three tied points so as to bind up and fix at three fixed points of a foot of a wearer.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
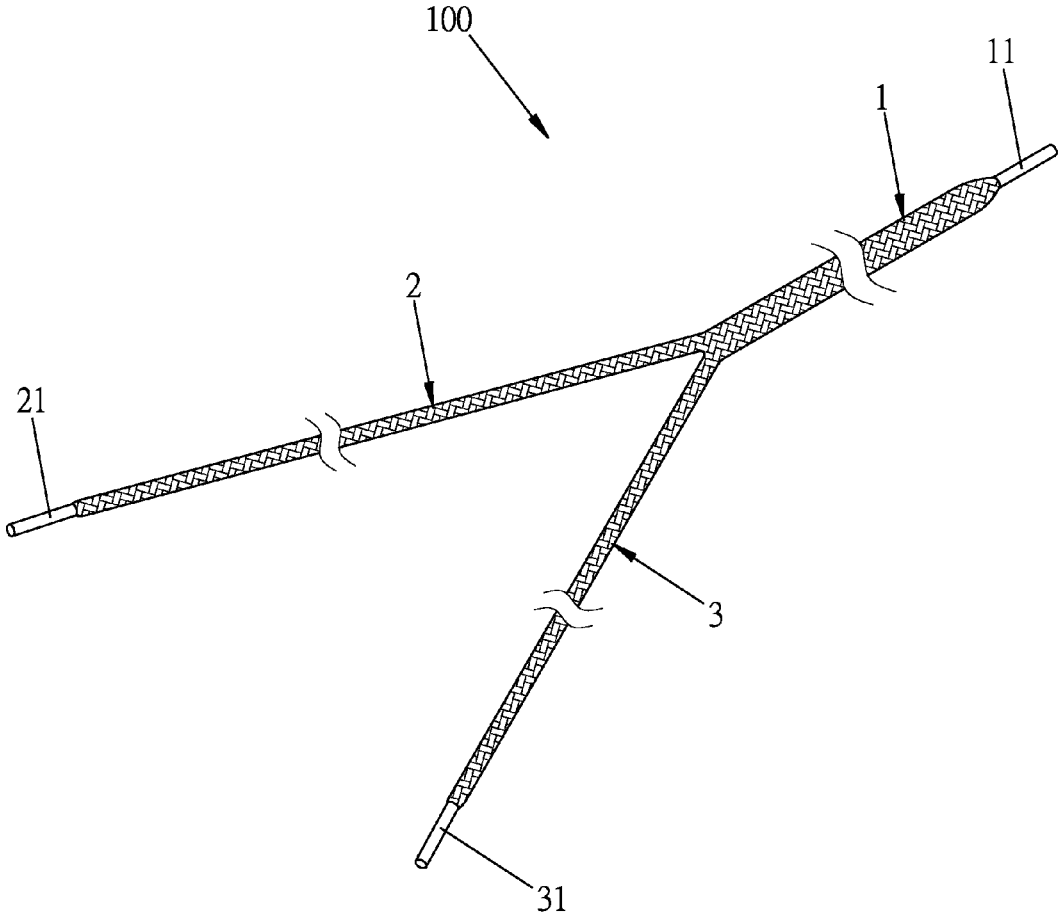
FIG. 1 is a perspective view of a three-way shoelace structure of the present invention.
Figure 2:
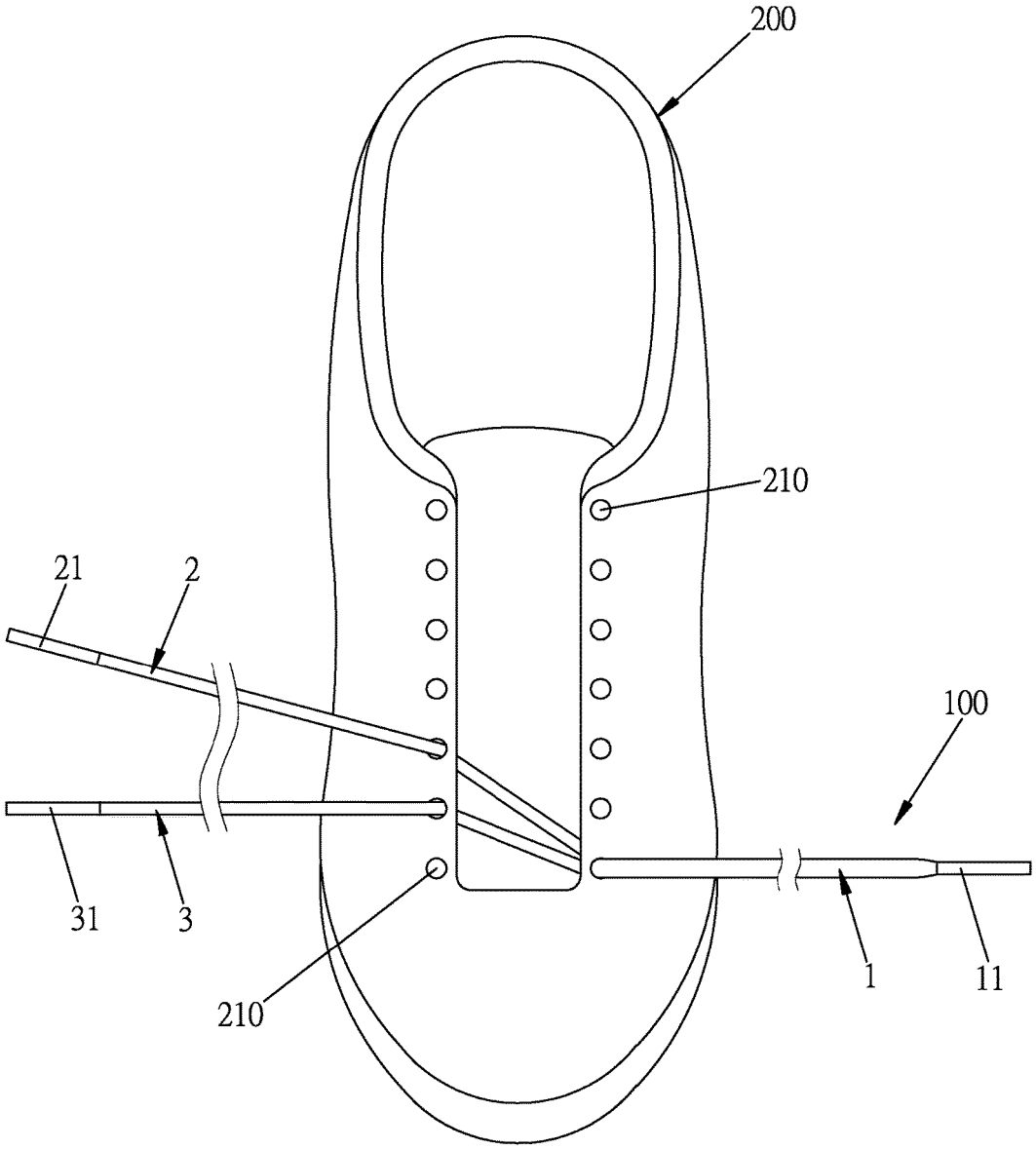
FIGS. 2 to 5 are the operational views of two three-way shoelace structures of the present invention which is passing through a plurality of eyelets of a shoe.
Figure 3:
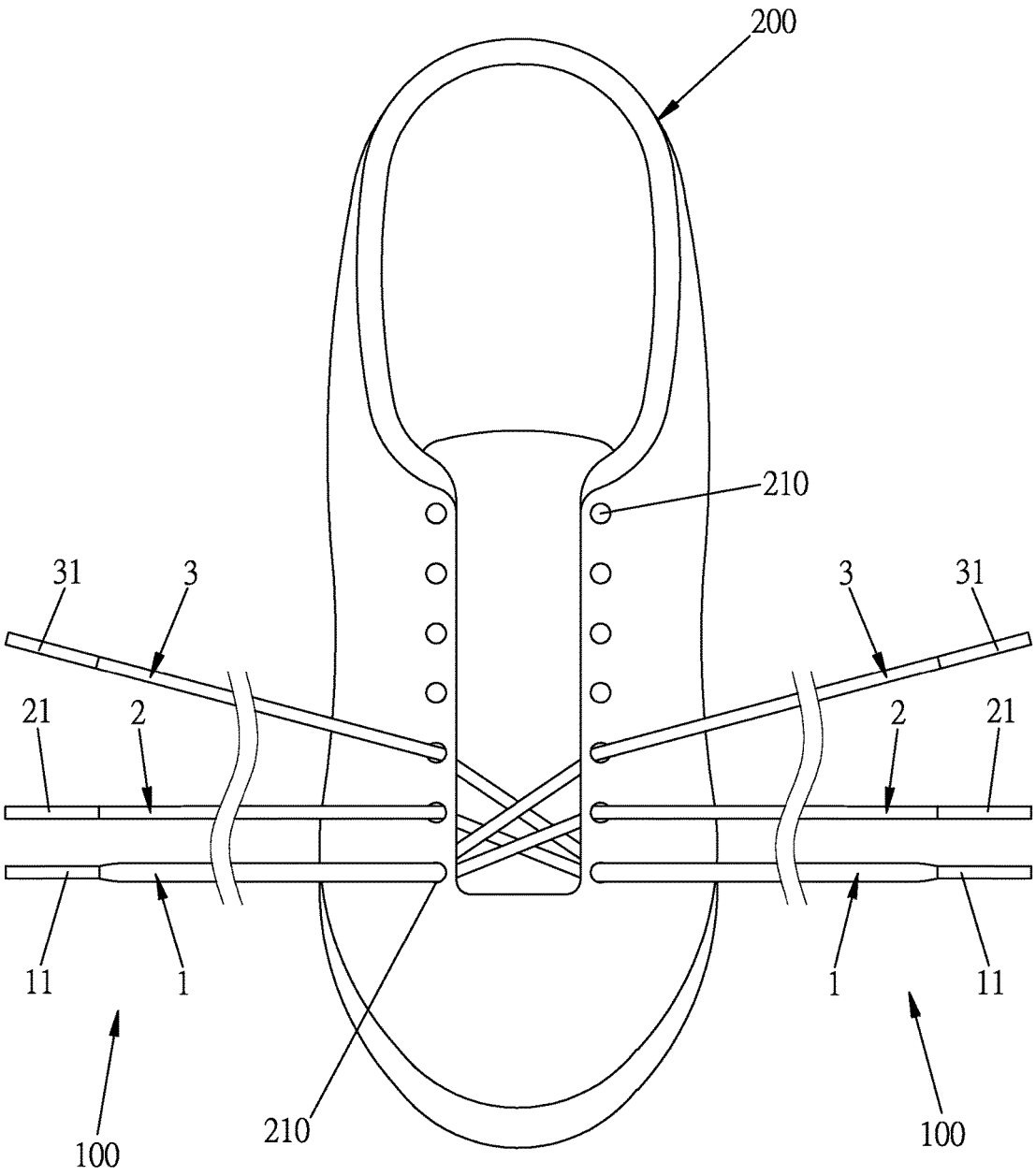
Figure 4:
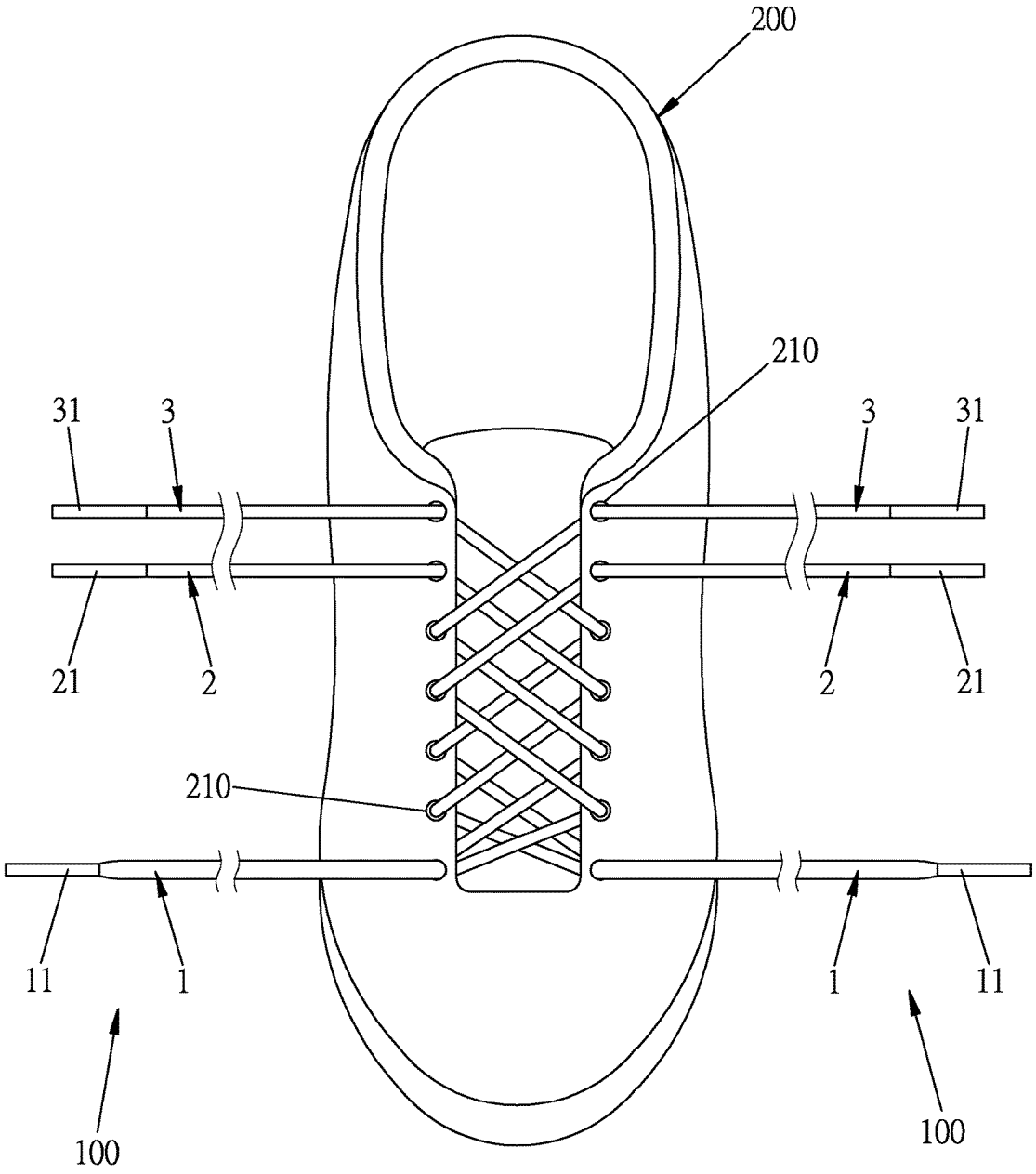
Figure 5:
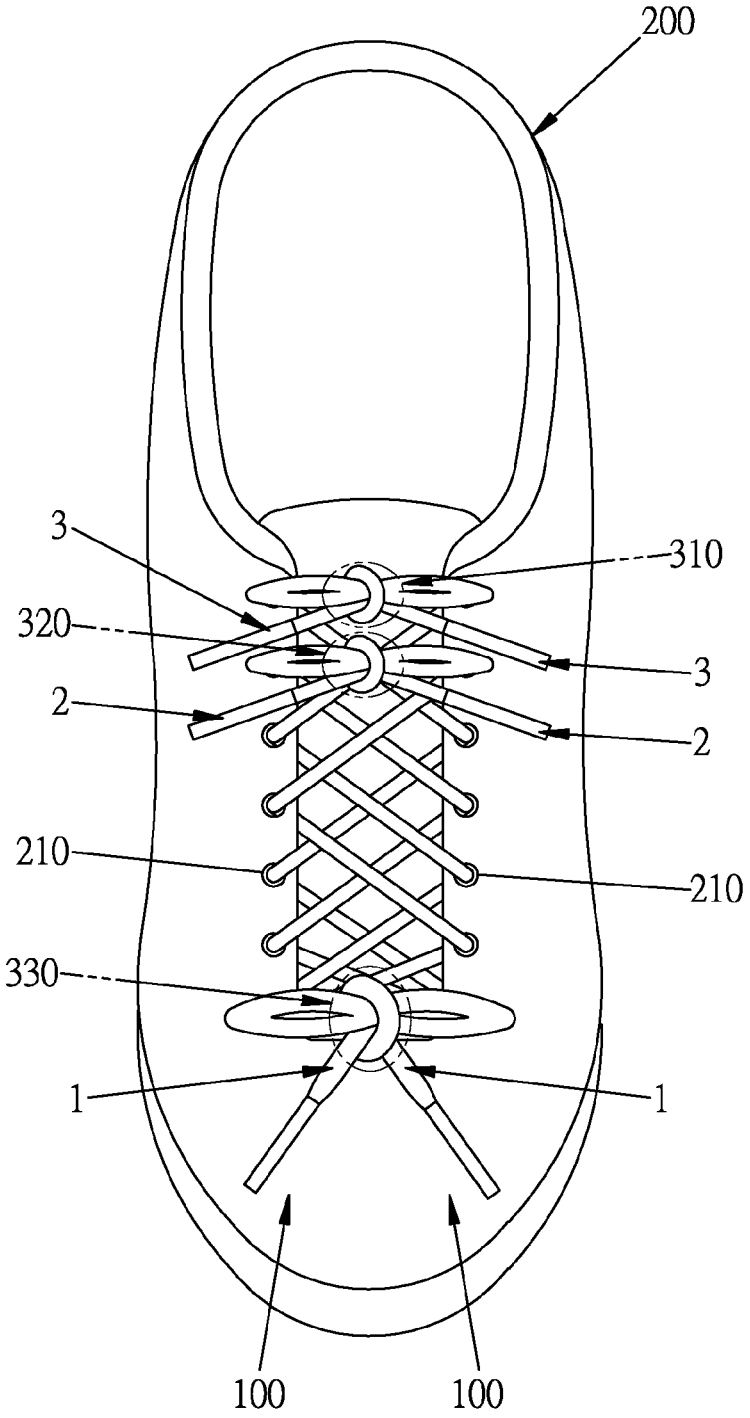

Referring now to the drawings where like characteristics and features among the various figures are denoted by like reference characters.

Please refer to FIG. 1, a three-way shoelace structure 100 of the present invention may comprise a first lace 1, a second lace 2, and a third lace 3.

One end of the first lace 1 has a first head 11.

One end of the second lace 2 has a second head 21, and the other end of the second lace 2 opposite to the second head 21 is connected to the end of the first lace 1 opposite to the first head 11.

One end of the third lace 3 has a third head 31, and the other end of the third lace 3 is connected to the end of the first lace 1 opposite to the first head 11 and the end of the second lace 2 opposite to the second head 21.

The first lace 1, the second lace 2, and the third lace 3 are formed a Y-shaped structure.

Since the first lace 1, the second lace 2, and the third lace 3 are woven in the same process, a diameter of the first lace 1 is larger than a diameter of the second lace 2 and the diameter of the first lace 1 is larger than a diameter of the third lace 3.

Please refer to FIGS. 2 to 5, when a first three-way shoelace structure 100 and a second three-way shoelace structure 100 are passing through a plurality of eyelets 210 of a shoe 200, the first lace 1, the second lace 2, and the third lace 3 of the first three-way shoelace structure 100 may be tied with the first lace 1, the second lace 2, and the third lace 3 of the second three-way shoelace structure 100 to form three tied points 310, 320, 330 so as to bind up and fix at three fixed points (not shown) of a foot of a wearer (not shown).

In conclusion, according to above mentioned structure, when the three-way shoelace structure is tied, there are three tied points 310, 320, 330 are formed from top to bottom so as to bind up three fixed points corresponding to the foot of the wearer. Therefore, the wearer may select one, two, or three of the tied points to tie so as to adapt the feet with different sizes. And furthermore, the market may be more and the uses of the shoes may be much wider.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A three-way shoelace structure, comprising:

a first three-way shoelace structure; and a second three-way shoelace structure;

each of the first three-way shoelace structure and the second three-way shoelace structure, comprising:

a first lace, one end thereof has a first head;

a second lace, one end thereof has a second head, the other end of the second lace opposite to the second head is connected to the other end of the first lace opposite to the first head; and a third lace, one end thereof has a third head, the other end of the third lace opposite to the third head is connected to the other end of the first lace opposite to the first head and the other end of the second lace opposite to the second head; and wherein the first three-way shoelace structure and the second three-way shoelace structure pass through a plurality of eyelets of a shoe, the first lace, the second lace, and the third lace of the first three-way shoelace structure are tied with the first lace, the second lace, and the third lace of the second three-way shoelace structure forming three bow-tied points so as to bind up and fix at three fixed points of a foot of a wearer.

2. The three-way shoelace structure as claimed in claim 1, wherein the first lace, the second lace, and the third lace each of the first three-way shoelace structure and the second three-way shoelace structure formed a Y-shaped structure.

3. The three-way shoelace structure as claimed in claim 1, wherein a diameter of the first lace is larger than a diameter of the second lace, and the diameter of the first lace is larger than a diameter of the third lace, of each of the first three-way shoelace structure and the second three-way shoelace structure.

* * * * *